United States Patent [19]

Shibayama et al.

[11] Patent Number: 4,782,358

[45] Date of Patent: Nov. 1, 1988

[54] DEVICE FOR SEPARATING TRANSFER SHEET

[75] Inventors: Tetsuhiro Shibayama, Kawasaki; Haruhisa Honda, Yokohama, both of Japan

[73] Assignee: Canon Kabushiki Kaisha, Tokyo, Japan

[21] Appl. No.: 39,985

[22] Filed: Apr. 20, 1987

[30] Foreign Application Priority Data

Apr. 18, 1986 [JP] Japan ..... 61-088196
Jun. 2, 1986 [JP] Japan ..... 61-125781
Jun. 18, 1986 [JP] Japan ..... 61-143926

[51] Int. Cl.[4] ..... G03G 15/14

[52] U.S. Cl. ..... 355/3 TR; 355/3 R; 355/3 CH

[58] Field of Search ..... 355/3 R, 3 TR, 3 CH, 355/14 TR

[56] References Cited

U.S. PATENT DOCUMENTS 3,954,332 5/1976 Fisher ..... 355/3 TR
4,134,147 1/1979 Watanabe ..... 355/3 CH X
4,367,036 1/1983 Sakamaki et al. ..... 355/14 R
4,610,530 9/1986 Lehmbeck et al. ..... 355/3 TR X
4,645,327 2/1987 Kimura et al. ..... 355/3 R
4,676,627 6/1987 Ohno ..... 355/3 TR X

*Primary Examiner*—Arthur T. Grimley
*Assistant Examiner*—Jane Lau
*Attorney, Agent, or Firm*—Fitzpatrick, Cella, Harper & Scinto

[57] ABSTRACT

A transfer material separating device for separating a transfer material from a surface of an image bearing member after an image formed on the image bearing member is electrostatically transferred onto a transfer material at a transfer station includes a separating electrode, disposed downstream of the transfer station with respect to movement direction of the transfer material, for causing electric discharge between the transfer material and the separating electrode, and a moisture absorbable member disposed adjacent the separating electrode and electrically isolated, the moisture absorbable member being capable of absorbing moisture and having an electric resistance which changes with moisture absorbed thereby.

30 Claims, 3 Drawing Sheets

DEVICE FOR SEPARATING TRANSFER SHEET

FIELD OF THE INVENTION AND RELATED ART

The present invention relates to an image forming apparatus such as an electrostatic copying machine and an electrostatic printer, which uses an electrostatic image transfer process, and more particularly to a device for separating a transfer material.

An image forming apparatus is known in which a transfer material, usually sheets of paper, is contacted to a visualized image made of charged toner particles on a surface on an image bearing member, and a transfer charger is operated at the backside of the transfer sheet to transfer the toner image onto the transfer material; and then, the transfer material is separated from the image bearing member.

In the apparatus of this type, the transfer charger applies an electric charge having a polarity opposite to that of the toner image to the transfer sheet so as to electrostatically transfer the toner image to the transfer material such as paper. Therefore, there is a tendency that the transfer material, even after the image has been transferred, is relatively strongly attached to the image bearing member by resulting electrostatic force. This requires that the transfer material is positively separated from the image bearing member at a position after the image transfer.

As for conventional separating means for this purpose, there is mechanical means such as a separating pawl and a separating belt, a device using air flow, and a separation charger for attenuating the electric charge having been applied for the purpose of the image transfer. A further method of separation is that the transfer material is guided along a guide having a large curvature adjacent the image transfer station so as to cause the transfer sheet to be separated from the image bearing member by its own resiliency or its own weight. Those means and method have respective advantages and disadvantages, and they are practically utilized in commercialized machines.

On the other hand, it is a recent trend that smaller image forming apparatuses are desired. From this standpoint, the above described method wherein the curvature is utilized is preferable because no complicated mechanism is required for the separation, but it involves a significant problem that the separation is liable to fail when the transfer material is relatively thin.

In consideration of the disadvantage of the above described method, it has been proposed that a small separating electrode means in the form of needles or an electrode in the form of a plate is disposed downstream of the transfer charger with respect to movement direction of the transfer material, or that a bias voltage which is lower than a spontaneous discharge starting voltage and which is opposite in polarity to the transfer corona is applied to the eletrode or electrodes to remove the electric charge from the transfer material, as described in U.S. Ser. Nos. 814,968 and 843,233, which have been assigned to the Assignee of this application.

Due to the bias voltage, a small separating device can be provided without the possibility of damaging the image bearing member and without the possibility of disturbing the formed toner image.

However, the separating device of this type does not always operate satisfactorily since the paper which is most frequently used as the transfer material changes remarkably in its properties depending on the moisture it contains, which in turn change due to ambient conditions.

More particularly, under low humidity conditions, an electric resistance of paper is high and is highly capable of retaining electric charge, with the result that it is strongly attached to the image bearing member after the image separation. Therefore, in order to satisfactorily separate it, the bias voltage applied to the separating electrode has to be increased. Under high humidity conditions, on the contrary, the resistance of the transfer paper is low, and therefore the electric charge is more freely movable, resulting in that the electric charge applied by the transfer charger leaks to the separating electrode through the transfer material during discharge of the separating electrode. Therefore, a sufficient strength of electric field can not be provided to effect the image transfer, whereby insufficient image transfer can occur wherein a part of the image is not transferred. In order to prevent this, the bias voltage applied to the separating electrode must be decreased.

With a view to avoiding these problems, it is considered that an ambient humidity or resistance of the transfer material is pre-detected, and in response to the detection, a discharge current from the separating electrode is controlled. However, it requires additional means such as detecting means and a control circuit, resulting in a bulky and complicated apparatus.

SUMMARY OF THE INVENTION

Accordingly, it is a principal object of the present invention to provide a transfer material separating device which can perform satisfactory image transfer and transfer material separating operation over a wide range of ambient conditions and of properties of a transfer material.

It is another object of the present invention to provide a transfer material separating device which is small in size.

It is a further object of the present invention to provide a separating device which can perform its separating operation over a wide range of qualities and thickness of the transfer material.

According to an embodiment of the present invention, a transfer material separating device is provided which comprises a separating electrode disposed downstream of an electrostatic image transfer means with respect to movement direction of the transfer material and an additional electrode made of a moisture absorbable material adjacent the separating electrode, the moisture absorbable material exhibiting low electric resistance when it absorbs moisture.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
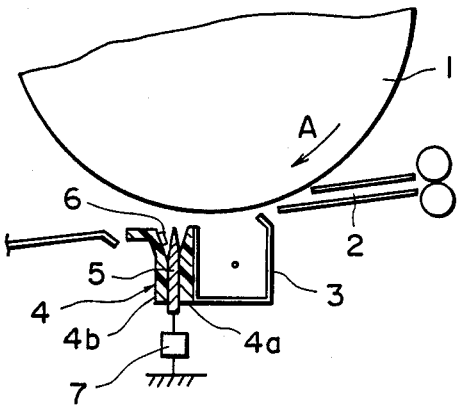
FIG. 1 is a sectional view of a transfer material separating device according to an embodiment of the present invention, wherein it is incorporated in an electrophotographic copying machine as an example of an image forming apparatus.

Referring to FIG. 1, there is shown a transfer material separating device according to an embodiment of the present invention, incorporated in an electrophotographic copying machine as an example of an image forming apparatus, wherein an image bearing member (an electrophotographic photosensitive member) is depicted by a reference numeral 1. The photosensitive member 1 is rotatable in the direction indicated by an arrow A. A toner image formed by known manner on the surface of the photosensitive member 1 is brought with rotation of the photosensitive member 1 to a transfer station where there is provided an image transfer charger 3. To the transfer station, an unshown transfer sheet of paper is conveyed in the direction of an arrow B along a conveying passage 2 into alignment with the toner image, whereby the transfer sheet is contacted to the toner image. The toner image is transferred onto the transfer sheet by an electric charge applied to the backside thereof by the transfer charger 3.

Around the photosensitive member 1, there are disposed a primary charger for uniformly charging the surface of the photosensitive member, an image information applying means to form an electrostatic latent image on the surface, a developing device for developing the latent image, a cleaning device for removing residual toner particles from the surface of the photosensitive member and a device for removing residual electric charge from the surface. Those means and an image forming process using them may be of a known type, and therefore, detailed description thereof is omitted, for the sake of simplicity of explanation.

The separating device comprises a couple of insulating members 4*a* and 4*b* which are disposed adjacent to the transfer charger 3 and which define an open space becoming larger toward the photosensitive member 1, and comprises a separating electrode 5 sandwiched therebetween.

The separating electrode 5 may comprise needles or a plate member of electrically conductive material such as a metal, the latter having a saw-teeth at that edge thereof adapted to be opposed to the transfer sheet P. The separating electrode 5 is electrically connected to a high voltage source 7.

A moisture absorbable member or electrode 6 which can absorb moisture, thereby decreasing in its electric resistance, such as paper, is mounted to such a surface of one of the insulating members which face the separating electrode 5. Also, the moisture absorbable member 6 is disposed adjacent to the free ends or end of the separating electrode 5. The moisture absorbable member 6 is electrically isolated, that is, it is electrically floated.

After completion of the image transfer operation, the transfer sheet P reaches the separating device and receives corona discharge having a polarity opposite to that applied in the transfer station, from the separating electrode 5, so that the electric charge having been applied during the image transfer operation is removed, whereby the transfer sheet is allowed to be separated from the photosensitive member by its resiliency and its own weight and then is conveyed to a next process.

Figure 2:
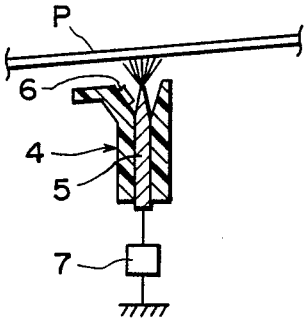
FIGS. 2 and 3 are sectional views illustrating electric discharge in the device shown in FIG. 1.

When the ambient humidity is low the electric resistance of the moisture absorbable member 6 is high, that is, insulating. Therefore, even if a high voltage is applied to the separating electrode 5, the electrostatic potential of the moisture absorbable member 6 resulting from an electrostatic induction relatively slowly increases. During the period from the completion of the image transfer to passage of the transfer sheet by the separating device, the electric lines of force are distributed as shown in FIG. 2 and are not disturbed. Therefore, the transfer sheet is sufficiently discharged, whereby the satisfactory separation of the transfer sheet is assured.

Figure 3:
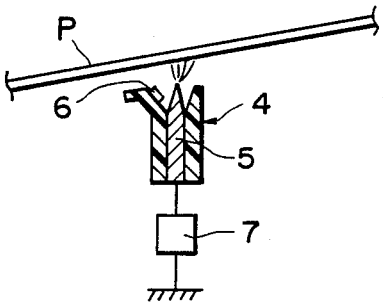

On the other hand, under high humidity conditions, the electric resistance of the moisture absorbable member 6 is relatively low, so that when a high voltage bias is applied to the separating electrode 5, the moisture absorbable member 6 is quickly charged by the electrostatic induction, and the potential thereof is quickly increased. Thus, as shown in FIG. 3, the corona discharge occurring between the transfer sheet and the separating electrode 5 is restrained by the existence of the relatively high potential member or electrode 6, and therefore, there is no leakage of the electric charge between the transfer material and the separating electrode 5 so that the image is completely transferred.

Figure 9:
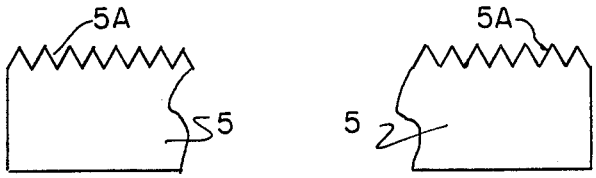
FIG. 9 is an elevational view, in section, of a separating electrode in accordance with the present invention.

A more detailed example will be described. A photosensitive membe 1 in the form of a cylinder having a diameter of 30 mm was used. The separating electrode 5 was a stainless steel plate having a thickness of 0.1 mm, which had saw-teeth 5A, as shown in FIG. 9, opposed to the photosensitive member 1, with a teeth height of 3 mm and teeth pitch of 1 mm. The separating electrode 5 was disposed 25 mm downstream of a wall of a transfer charger shield and was spaced from the transfer sheet by approx. 5 mm. As for the moisture absorbable member 6, a sheet of paper having a width of 1 mm was fastened to the electrode-opposing surface of the insulating member at a position 1–2 mm away from the free end of the separating electrode 5.

The separating device was incorporated in a copying machine with the image transfer voltage of −5.3 KV, a separating electrode bias voltage of +3.5 KV and a process speed (a speed of relative movement between the surface of the photosensitive member 1 and the separating device) of 50 mm/sec. A stabilized separating operation was confirmed without deterioration of image quality over a wide range of humidity (10–90%) for a thin sheet of paper (46 g/m$^2$) a thick sheet of paper (128 g/m$^2$) and a transparent resin sheet for overhead projector.

It will be understood that the moisture absorbable member 6 in this embodiment is not connected with any electrically conductive member, and therefore, it is electrically isolated or floated.

Figure 4:
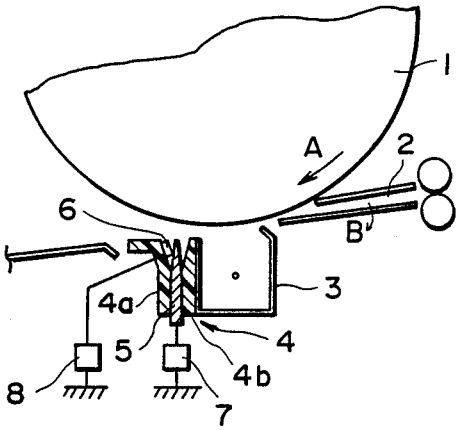
FIG. 4 is a sectional view of a transfer material separating device according to another embodiment of the present invention, wherein it is incorporated in an electrophotographic copying machine.

Referring to FIG. 4, a separating device according to another embodiment of the present invention will be described. In this embodiment, a constant voltage is applied to the moisture absorbable member 6, as contrasted with the first embodiment wherein the moisture absorbable member 6 is electrically isolated. The restraint of the discharge between the separating electrode 5 and the transfer sheet also occurs in this embodiment similarly to the first embodiment.

Further, under low humidity conditions, the moisture absorbable member 6 has such a high resistance that it is substantially an electrically insulating material. When the voltage is applied thereto from an electric bias source 8, the electric potential increases at a low speed determined by a time constant which, in turn, is determined by the electric resistance and the electrostatic capacity of the member. During the period in which the potential of the moisture absorbable member 6 is far below the potential of the separating electrode 5, as shown in FIG. 3 illustrating the first embodiment, the electric field is concentrated on the tip ends of the electrode 5, so that the corona discharge is easily produced between the transfer material P and the separating electrode 5, and therefore, the separation of the transfer material P is effective.

The application of the voltage to the moisture absorbable member 6 may be made intermittently so that the voltage application is effected only during the time in which the separating function is to be performed to the transfer material having come to the separating electrode 5 position after the image transfer. More particularly, the voltage application to the moisture absorbable member 6 is interrupted while there is no paper opposed to the separating device, or the voltage may be applied only during the leading portion of each of the transfer sheets being opposed thereto. By doing so, the separating operation can be performed more effectively, since the charge-up of the member 6 can be destructed periodically.

A more detailed example of this embodiment will be described.

The dimensions and materials are the same as with FIG. 1 embodiment, but a bias voltage of +2.8 KV was applied to the moisture absorbable member 6, and the bias voltage was applied intermittently, more particularly, it was applied for 6 seconds and not applied for 4 seconds. A stabilized separating operation was confirmed without deterioration of image quality over a wide range of humidity (10–90%) for a thin sheet of paper (46 g/m$^2$) a thick sheet of paper (128 g/m$^2$) and a transparent resin sheet for overhead projector.

Figure 5:
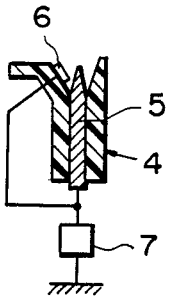
FIG. 5 is a sectional view of a transfer material separating device according to a further embodiment of the present invention.

Referring to FIG. 5, there is shown a separating device according to a further embodiment of the present invention, which is the same as the previous embodiment with the exception that a common bias source 9 is used for the separating electrode 5 and the moisture absorbable member 6, noting that the polarity of the applied voltage is the same. By this, the required space and manufacturing cost are reduced.

Figure 6:
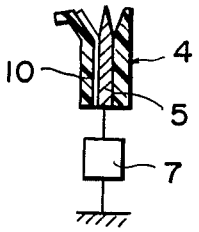
FIG. 6 is a sectional view of a transfer material separating device according to a further embodiment of the present invention.

FIG. 6 illustrates a separating device according to a further embodiment of the present invention. In this embodiment, the moisture absorbable member 10 is sandwiched together with the separating electrode 5 between the insulating members 4*a* and 4*b*, and further, the high voltage source 7 is commonly used. The wiring is simplified in this embodiment.

Where the bias voltage to the separating electrode 5 is increased in an attempt to ensure the separation of the transfer material under a low humidity condition, a problem arises that the moisture absorbable member 6 absorbs moisture under a high humidity condition and more or less restrains the discharge between the transfer sheet and the separating electrode 5, however, the restraint effect is not sufficient.

Figure 7:
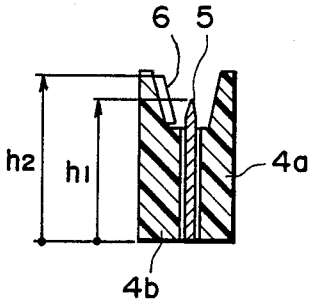
FIG. 7 is a sectional view of a transfer material separating device according to a further embodiment of the present invention.

FIG. 7 shows a further embodiment providing a solution to this problem. This embodiment is based on a finding that the relation between a tip end position of the separating electrode 5 and a top position of the moisture absorbable member 6 is significant. The heights $h_l$ and $h_2$ of those positions measured from a common base position are indicated in FIG. 7.

Experiments have been carried out under various bias voltages Vs to the separating electrode 5 and with various $\Delta h = h_2 - h_l$. Other conditions were as follows:

Image bearing member: Organic photosensitive member, 30 mm in diameter:

Rotational speed of the image bearing member: 50 mm/sec:

Image transfer voltage: −5.4 KV:

Separating electrode: stainless steel plate etched or pressed, 0.1 mm in thickness:

Moisture absorbable member 8: 0.1 mm in thickness.

The results are shown in the following Table.

TABLE 1

| | Vs | | | | |
|---|---|---|---|---|---|
| Δh | 2.8 KV | 3.0 | 3.2 | 3.5 | 3.8 |
| −1.0 mm | G | G | F | B | B |
| 0 | G | G | G | F | F |
| +1.0 mm | G | G | G | G | F |

Vs: bias voltage to the separating electrode
$\Delta h = h_2 - h_1$: height difference between tops of separating electrode 5 and moisture absorbable member 6

Evaluation

Evaluation was made from the image density of the transferred image, when a black image was copied:

G: Good

F: Fairly good (image density is slightly low)

B: Bad (hardly any image is transferred)

Under the above conditions, the bias voltage Vs had to be not less than +3.2 KV in order to provide stabilized separation of thin paper under the ambient relative humidity of 10%. The above Table 1 is based on the image density obtained from a black original with varied height ($h_2$) of the top position of the moisture absorbable electrode 6 under the ambient relative humidity of 90%.

As will be understood from the Table 1, Δh is desired to be not greater than approximately zero, in order to both stabilize the separation over a wide range from a low humidity to a high humidity and to provide a satisfactory image density of the transferred image.

In the foregoing embodiments, the moisture absorbable member or electrode 6 has been described as being disposed downstream of the separating electrode 5 with respect to movement direction of the transfer material. However, where it is disposed upstream thereof, the above-described advantages can still be provided to accertain degree.

As a yet further embodiment, it is effective to provide the moisture absorbable member 6 at each of upstream and downstream side thereof.

Figure 8:
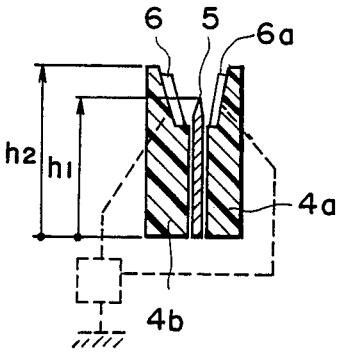
FIG. 8 is a sectional view of a transfer material separating device according to a further embodiment of the present invention.

FIG. 8 shows such an embodiment, wherein an additional moisture absorbable member 6*a* is mounted to the insulating member so as to face the separating electrode 5, thus providing the moisture absorbable members 6 and 6*a* adjacent both sides of the separating electrode 5. These moisture absorbable members 6 and 6*a* may be of the same material and may have the same configuration, but they may be different in thickness and/or width, as the case may be. The bias voltages applied to those moisture absorbable members 6 and 6*a* may be the same or may be different, as the case may be. These onditions may be properly determined by one skilled in the art in consideration of a diameter of the image bearing member, electrostatic force and/or configuration of the transfer material conveying passage.

An example of the change of the discharge current from the transfer sheet to the separating electrode 5 in accordance with ambient humidity change is shown in the following Table 2, when the moisture absorbable member 6 is provided and when it is not provided:

TABLE 2

| Relative humidity (%) | Surface resistance (Ohm) | Current to separating electrode with absorbable member | Current to separating electrode without absorbable member |
|---|---|---|---|
| 10 | $10^{15}$ | 100 | 50 |
| 60 | $5.6 \times 10^{11}$ | 80 | 70 |
| 90 | $10^{8}$ | 35–40 | 60–70 |

The experimental conditions were the same as the above with FIG. 7, with the exception that the moisture absorbable members 6 and 6*a* were provided adjacent both sides of the separating electrode, as shown in FIG. 8. Each of the moisture absorbable members were made of plain paper (64 kg/m$^2$), the same material as the transfer sheet. The width thereof was 5 mm. The same voltage as that supplied to the separating electrode 5 was supplied to the members 6 and 6*a*. The space between the transfer sheet and the separating electrode 6 was 5 mm.

In the foregoing embodiments, the image bearing member have been described as being an electrophotographic photosensitive drum as an example. However, it may be in the form of a belt. Further, the image bearing member is not limited to the electrophotographic photosensitive member, but may be another member, such as an insulating member, which can support a toner image which is to be transferred therefrom to a transfer material. The image transfer means is not limited to a corona discharger, but may be an image transfer roller to which a bias voltage is applied. Further, the separating electrode may be in the form of a saw-teeth electrode or may be a bundle of independent needles.

The moisture absorbable member functioning as a moisture absorbable electrode may be made of cellophane, synthetic resin, high polymer, ceramic and another material as well as paper, provided that the electric resistance thereof changes when it absorbs moisture. As another example, moisture absorbable material may be painted to an insulating member adjacent to the separating electrode.

As described in the foregoing, according to the present invention, a very simple and small in size structure is effective to perform a stabilized transfer material separating operation over a wide relative humidity range, for various transfer materials and without image deterioration such as partly missed image transfer.

According to the embodiment described with FIG. 7, the height relationship between the separating electrode and the moisture absorbing electrode is effective to provide satisfactory image density of the transferred image over a wide range of the relative humidity and with stabilized separation of the transfer material.

While the invention has been described with reference to the structures disclosed herein, it is not confined to the details set forth and this application is intended to cover such modifications or changes as may come within the purposes of the improvements or the scope of the following claims.

What is claimed is:

1. A transfer material separating device for separating a transfer material from a surface of an image bearing member after an image formed on the image bearing member is electrostatically transferred onto a transfer material at a transfer station, comprising:

a separating electrode, disposed downstream of the transfer station with respect to movement direction of the transfer material, for applying electric discharge between the transfer material and said separating electrode; and a moisture absorbable member disposed adjacent said separating electrode and electrically isolated, said moisture absorbable member being capable of absorbing moisture and having an electric resistance which changes with moisture absorbed thereby.

2. A device according to claim 1, wherein a bias voltage is applied to said moisture absorbable member.

3. A device according to claim 2, wherein the bias voltage has a polarity which is the same as a polarity of a bias voltage applied to said separating electrode.

4. A device according to claim 2 or 3, wherein said bias voltage applied to said moisture absorbable member is intermittently applied.

5. A device according to claim 2, wherein the bias voltages are applied from a common voltage source.

6. A device according to claim 1, wherein an end of said moisture absorbable member which is closest to the image bearing member is closer to the image bearing member than an end of said electrode closest to the image bearing member.

7. A device according to claim 1, wherein said separating electrode has saw-teeth.

8. A device according to claim 1, wherein the insulating member has a surface facing to said separating electrode, and wherein said moisture absorbable member is mounted to the surface of the insulating member.

9. A device according to claim 8, wherein the surface of the insulating member is away from said separating electrode toward the image bearing member.

10. A device according to claim 1, wherein said moisture absorbable member is of paper material.

11. A transfer material separating device for separating a transfer material from a surface of an image bearing member after an image formed on the image bearing member is electrostatically transferred onto a transfer material at a transfer station, comprising:

a separating electrode, disposed downstream of the transfer station with respect to movement direction of the transfer material, for causing electric discharge between the transfer material and said separating electrode; and a moisture absorbable member disposed adjacent said separating electrode and downstream of said separating electrode with respect to the movement direction, said moisture absobable member being capable of absorbing moisture and having an electric resistance which changes with moisture absorbed thereby.

12. A device according to claim 11, wherein said moisture absorbable member is electrically isolated.

13. A device according to claim 11, wherein a bias voltage is applied to said moisture absorbable member.

14. A device according to claim 13, wherein the bias voltage has a polarity which is the same as a polarity of a bias voltage applied to said separating electrode.

15. A device according to claim 13 or 14, wherein said bias voltage applied to said moisture absorbable member is intermittently applied.

16. A device according to claim 13, wherein the bias voltages are applied from a common voltage source.

17. A device according to claim 11, wherein an end of said moisture absorbable member which is closest to the image bearing member is closer to the image bearing member than an end of said separating electrode closest to the image bearing member.

18. A device according to claim 11, further comprising an additional moisture absorbable member disposed upstream of said separating electrode with respect to the movement direction.

19. A transfer material separating device for separating a transfer material from a surface of an image bearing member after an image formed on the image bearing member is electrostatically transferred onto a transfer material at a transfer station, comprising:

a separating electrode, disposed downstream of the transfer station with respect to movement direction of the transfer material, for causing electric discharge between the transfer material and said separating electrode; and a moisture absorbable member disposed adjacent said separating electrode and downstream of said separating electrode with respect to the movement direction, said moisture absorbable member being mounted on an insulating member and being capable of absorbing moisture and having an electric resistance which changes with moisture absorbed thereby.

20. A transfer material separating device for separating a transfer material from a surface of an image bearing member after an image formed on the image bearing member is electrostatically transferred onto a transfer material at a transfer station, comprising:

a separating electrode, disposed downstream of the transfer station with respect to movement direction of the transfer material, for causing electric discharge between the transfer material and said separating electrode;

an insulating member for supporting said separating electrode; and a moisture absorbable member disposed adjacent said separating electrode and downstream of said separating electrode with respect to the movement direction, said moisture absorbable member being mounted on said insulating member so as to be exposed to said separating electrode and being capable of absorbing moisture and having an electric resistance which changes with moisture absorbed thereby.

21. A device according to claim 20, wherein an end of said moisture absorbable member which is closest to the image bearing member is closer to the image bearing member than an end of said separating electrode closest to the image bearing member.

22. A device according to claim 20 or 21, further comprising an additional moisture absorbable member disposed upstream of said separating electrode.

23. A transfer material separating device for separating a transfer material from a surface of an image bearing member after an image formed on the image bearing member is electrostatically transferred onto a transfer material at a transfer station, comprising:

a separating electrode, disposed downstream of the transfer station with respect to movement direction of the transfer material and supplied with a voltage having a predetermined polarity, for causing electric discharge between the transfer material and said separating electrode;

a moisture absorbable member disposed adjacent said separating electrode and capable of absorbing moisture and having an electric resistance which changes with moisture absorbed thereby; and a voltage source for applying a predetermined voltage having the same polarity to said moisture absorbable member.

24. A device according to claim 23, wherein the bias voltage has a voltage level which is the same as a voltage level of a bias voltage applied to said separating electrode.

25. A device according to claim 24, wherein said bias voltage applied to said moisture absorbable member is intermittently applied.

26. A device according to claim 24 or 25, wherein the bias voltages are applied from a common voltage source.

27. A device according to claim 23, where said moisture absorbable member is disposed downstream of said separating electrode with respect to movement direction of the transfer material.

28. A device according to claim 27, further comprising an additional moisture absorbable member disposed upstream of said separating electrode with respect to movement direction of the transfer material.

29. A device according to claim 23, wherein said separating electrode has saw-teeth.

30. A device according to claim 23, wherein said moisture absorbable member is of paper material.

* * * * *

UNITED STATES PATENT AND TRADEMARK OFFICE

CERTIFICATE OF CORRECTION

PATENT NO. : 4,782,358

DATED : November 1, 1988

INVENTOR(S) : TETSUHIRO SHIBAYAMA, ET AL.

It is certified that error appears in the above-identified patent and that said Letters Patent is hereby corrected as shown below:

Column 1, line 58, "eletrode" should read --electrode--.

Column 4, line 41, "membe l" should read --member l--.

Column 6, line 61, "accertain" should read --a certain--.

Column 7, line 7, "onditions" should read --conditions--.

Column 8, line 65, "absobable" should read --absorbable--.

Signed and Sealed this

Eleventh Day of April, 1989

*Attest:*

*Attesting Officer*

DONALD J. QUIGG

*Commissioner of Patents and Trademarks*